US005168656A

United States Patent [19]

Jolly et al.

[11] Patent Number: 5,168,656

[45] Date of Patent: Dec. 8, 1992

[54] BELT/DISC SANDER WITH QUICK RELEASE AND LOCKING MEANS FOR SWINGABLE BED

[75] Inventors: Robert C. Jolly, Buffalo Grove; Roger D. Neitzell, Park Ridge, both of Ill.

[73] Assignee: Skil Corporation, Chicago, Ill.

[21] Appl. No.: 743,508

[22] Filed: Aug. 9, 1991

[51] Int. Cl.[5] ..... B24B 21/00

[52] U.S. Cl. ..... 51/3; 51/147; 51/166 R; 51/273

[58] Field of Search ..... 51/135 R, 147, 3, 166 R, 51/273

[56] References Cited

U.S. PATENT DOCUMENTS 4,924,633 5/1990 Hock et al. ..... 51/135 R

FOREIGN PATENT DOCUMENTS 0580811 9/1924 France ..... 51/135 R
0412704 2/1946 Italy ..... 51/135 R
0647853 12/1950 United Kingdom ..... 51/135 R

*Primary Examiner*—Roscoe V. Parker
*Attorney, Agent, or Firm*—Jones, Day, Reavis & Pogue

[57] ABSTRACT

A quick release for enabling a belt bed in a belt sander to be selectively rotated 90° from the horizontal to the vertical in a simple manner. A C-shaped collar forms a portion of the frame and a support is attached to the belt bed and positioned within the C-shaped collar. The C-shaped collar may be tightened about the support in either the horizontal or vertical position of the belt bed to maintain the bed in the selected position.

3 Claims, 9 Drawing Sheets

154

Fig.13
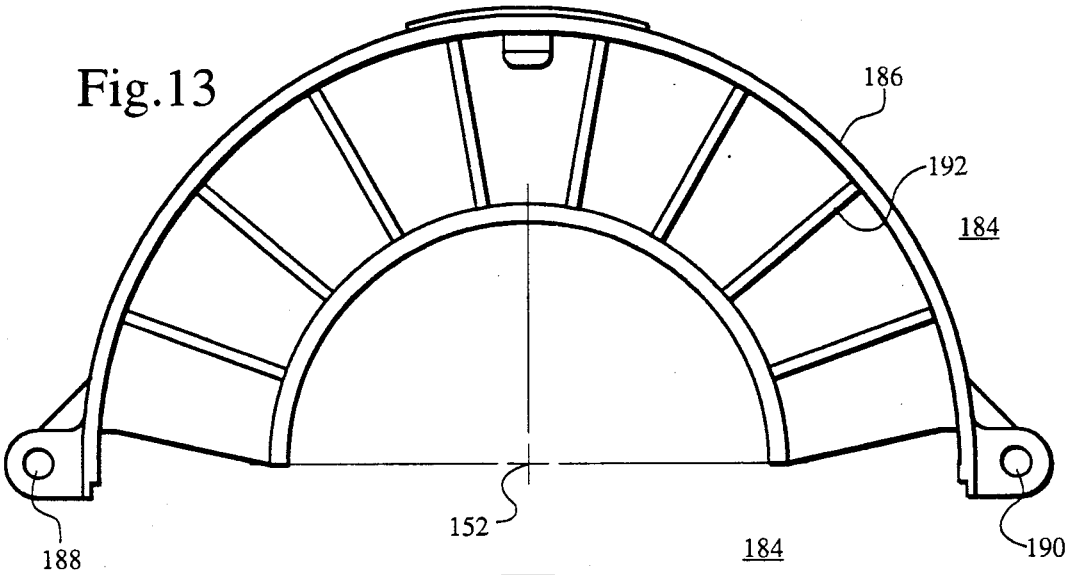
Fig.14
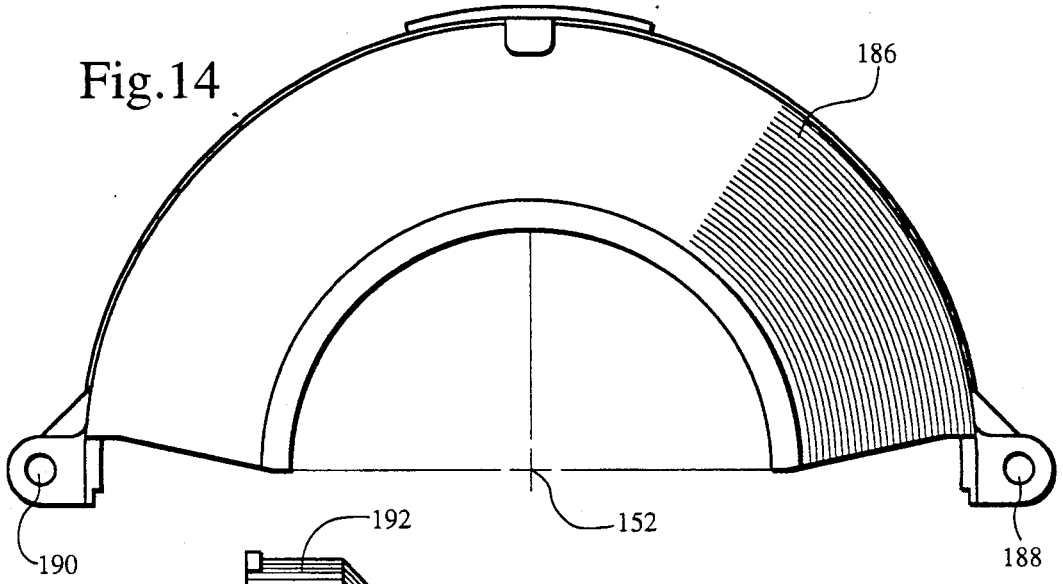
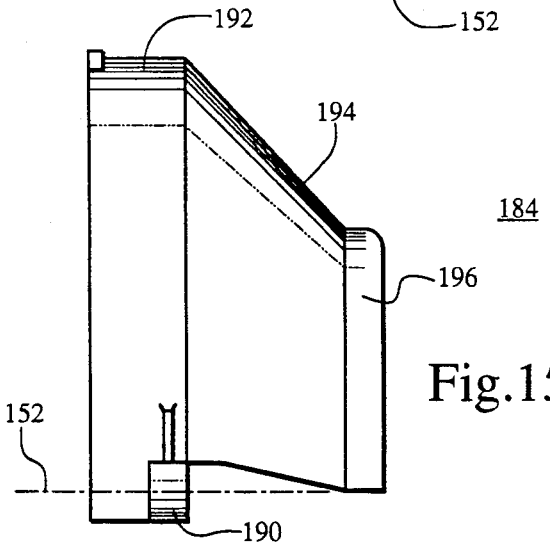
Fig.15

BELT/DISC SANDER WITH QUICK RELEASE AND LOCKING MEANS FOR SWINGABLE BED

FIELD OF THE INVENTION

The present invention relates to belt sanders in general and in particular to a belt sander with a quick release and locking means for the swingable bed that locks the bed in either its horizontal or a vertical position for use when sanding a workpiece.

BACKGROUND OF THE INVENTION

Belt-type sanders are old and well known in the art. They have an extended belt bed with an idler pulley at one end and a driven pulley at the other. An adjustment mechanism moves the idler pulley in sufficiently far to allow an endless belt having an emery-type surface for sanding purposes to be placed thereon. The idler pulley is then adjusted outwardly until the belt is tight about the drive pulley and the idler pulley. The belt bed allows a workpiece to be sanded to be placed on the bed while the belt is being driven and thus the workpiece is sanded.

As can be imagined, the sanding operation generates a considerable amount of dust. In the prior art, a dust collector is placed around the driving pulley to encircle the end of the belt carrying the dust toward the dust collector. A vacuum of any known type may be coupled to an orifice on the dust collector and the dust removed by the vacuum as it enters the dust collector.

An end stop is generally placed in front of the dust collector and just above the surface of the belt. The end stop allows the work piece to rest against it for supporting the work piece while it is being sanded. It is raised a small distance above the belt so that the dust being generated can be carried by the belt into the dust collector.

Further, the belt table has the ability to move from its horizontal position to a vertical position for facilitating certain types of sanding. Typically, when the belt is in its horizontal position, it is held rigidly by two bolts that pass through the frame into the belt bed. Therefore, in order to tip the bed upwardly 90°, the two bolts must be removed, the belt tilted 90° and the bolts reinserted into the frame and the belt bed. Clearly this is time-consuming and an inconvenience to the user of the sander. In addition, one should know reasonably accurately when the belt is in its vertical and horizontal positions. The ability to place the bed in either the horizontal or vertical planes in an accurate manner should be done in a manner that is relatively quick and easy for the user of the machine.

The present invention overcomes the disadvantages of the prior art by providing a belt sander which has a single set screw or bolt to lock the belt bed to the frame in any desired position. This is accomplished by having a C-shaped collar forming a portion of the frame. A circular support structure, such as a wheel-like device with a wide surface on the periphery thereof, is attached to the belt bed and positioned within the C-shaped collar that forms a portion of the frame. The circular support structure rides within the C-shaped collar and enables the belt bed to be selectively rotated 90° from a horizontal position to the vertical position. By loosening the set screw or bolt on the C-shaped collar, pressure is relieved about the circular support means to allow the belt bed to pivot. However, when the set screw is tightened, the ends of the C-shaped collar move toward each other and clamp about the circular support means to prevent the belt bed from rotating. The C-shaped clamp has a flat inner surface and the flat outer surface of the circular support structure is placed in mating contact with the flat inner surface of the C-shaped collar so that as the C-shaped collar is tightened by the set screw, it will grip the flat outer surface of the circular support structure and hold it in fixed relationship. A recess is formed in each outer end of the C-shaped collar. An orifice in one recess extends in alignment to an orifice in the other recess and the set screw or bolt is inserted in the aligned orifices which, when tightened, pulls the ends of the C-shaped collar together and clamps it about the circular support structure to lock the bed in the selected position.

A bed position indexing pin extends outwardly from the C-shaped collar. A device is associated with the circular support structure on the bed for engaging the pin at 0° and 90° to position the belt bed with a positive stop at the 0° and 90° positions. The device is an annular fixture that extends through the C-shaped collar. A first inwardly-extending flange on a first end of the annular fixture is on the inside of the C-shaped collar for attachment to the circular support structure rigidly mounted to the belt bed. A second outwardly-extending flange on the other end of the annular fixture is on the outside of the C-shaped collar and rotates with the belt bed when it is moved from the 0° to the 90° position. An arcuate recess is formed in the second flange for receiving the indexing pin. It has a first shoulder for engaging the indexing pin at a 0° horizontal belt bed position and a second shoulder for engaging the indexing pin at a 90° vertical belt bed position so as to provide automatic stops at the correct 0° and 90° belt bed positions.

Thus it is an object of the present invention to provide a belt-type sander which has a bed that can be moved from the horizontal position (0°) to a vertical position (90°) and which has a single bolt or set screw that can be loosened to move the bed to the desired position and then tightened to lock the bed into position.

It is also an object of the .present invention to provide an indexing pin on the frame that engages an arcuate slot in a flange attached to the belt bed such that in a first position, a first shoulder in the recess engages the indexing pin at the 0° position and a second shoulder in the recess engages the indexing pin at the 90° position, thus providing positive stops and accurately positioning the belt bed at the 0° and 90° positions.

SUMMARY OF THE INVENTION

Thus the present invention relates to a belt sander having a quick release for enabling a belt bed to be selectively rotated 90° from the horizontal to the vertical. A C-shaped collar forms a portion of the sander frame. Support means is attached to the belt bed and positioned within the C-shaped collar for enabling the belt bed to be selectively rotated 90° from the horizontal position to the vertical position. Means are provided for tightening the C-shaped collar about the support means in either the horizontal or vertical position of the belt bed to maintain the bed in the selected position. The C-shaped clamp has a flat inner surface and the circular support structure has a flat outer surface for contacting the flat inner surface of the C-shaped collar. A recess is formed in each outer end of the C-shaped collar and an orifice extends from one recess through the other recess in alignment. A bolt or set screw is inserted in the orifice which, when tightened, compresses the ends of the C-shaped collar about the circular support structure and locks the circular support structure to the C-shaped collar so that the belt bed cannot move.

An indexing pin associated with the frame provides positive stops for the belt bed and accurately positions the belt bed in either the horizontal or vertical planes.

BRIEF DESCRIPTION OF THE DRAWINGS

These and other objects of the present invention will be more fully understood in conjunction with the accompanying drawings in which like numbers indicate like components and in which:

FIG. 13 is a front view of the upper section of the dust cover for the disc sander;

FIG. 14 is a rear view of the upper cover for the disc sander in the FIG. 13;

FIG. 15 is a side view of the upper section of the dust cover for the disc sander and shown in FIG. 13 and 14;

DETAILED DESCRIPTION OF THE DRAWINGS

Figure 1:
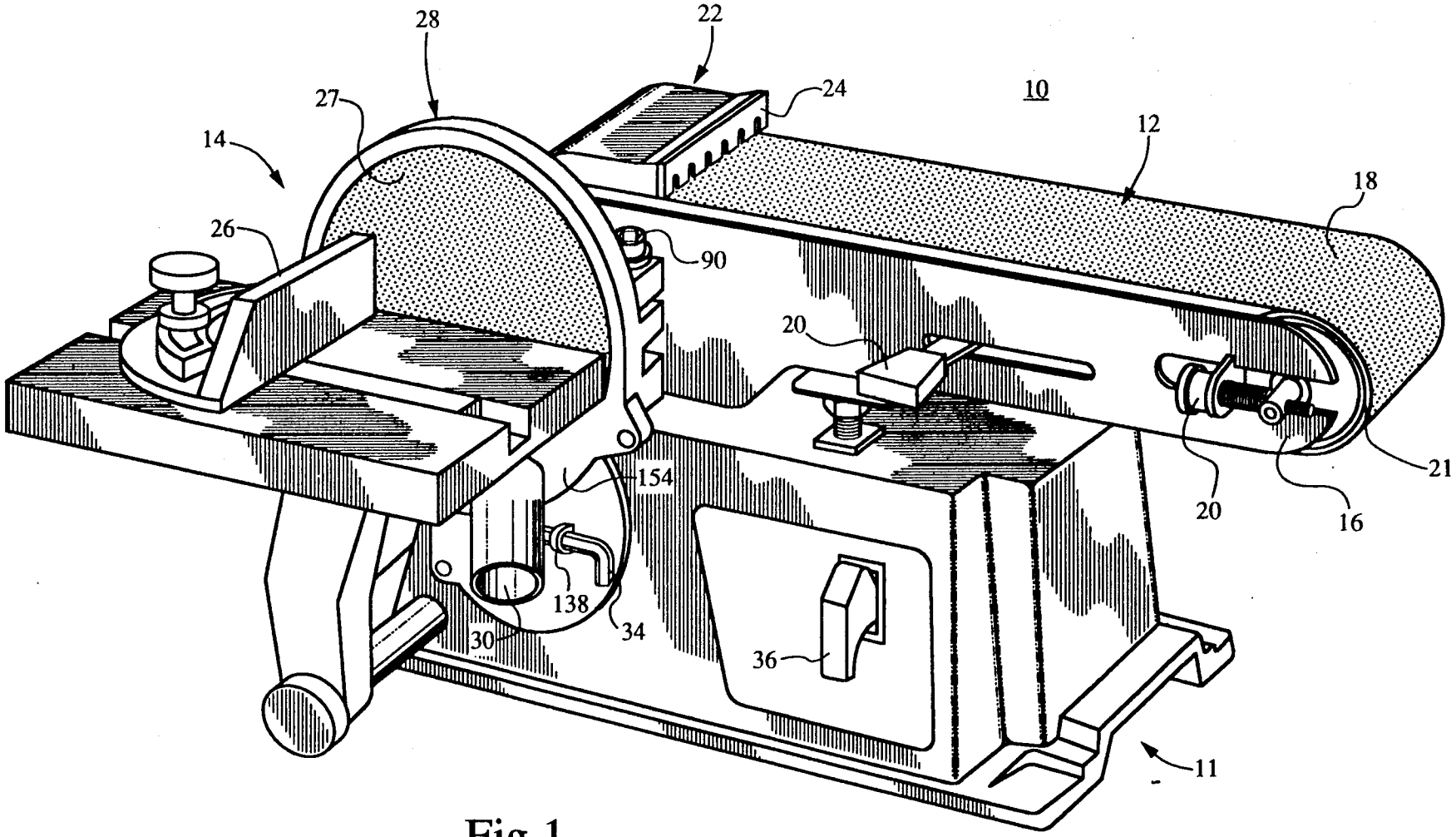
FIG. 1 is a perspective view of a belt disc sander.
Figure 2:
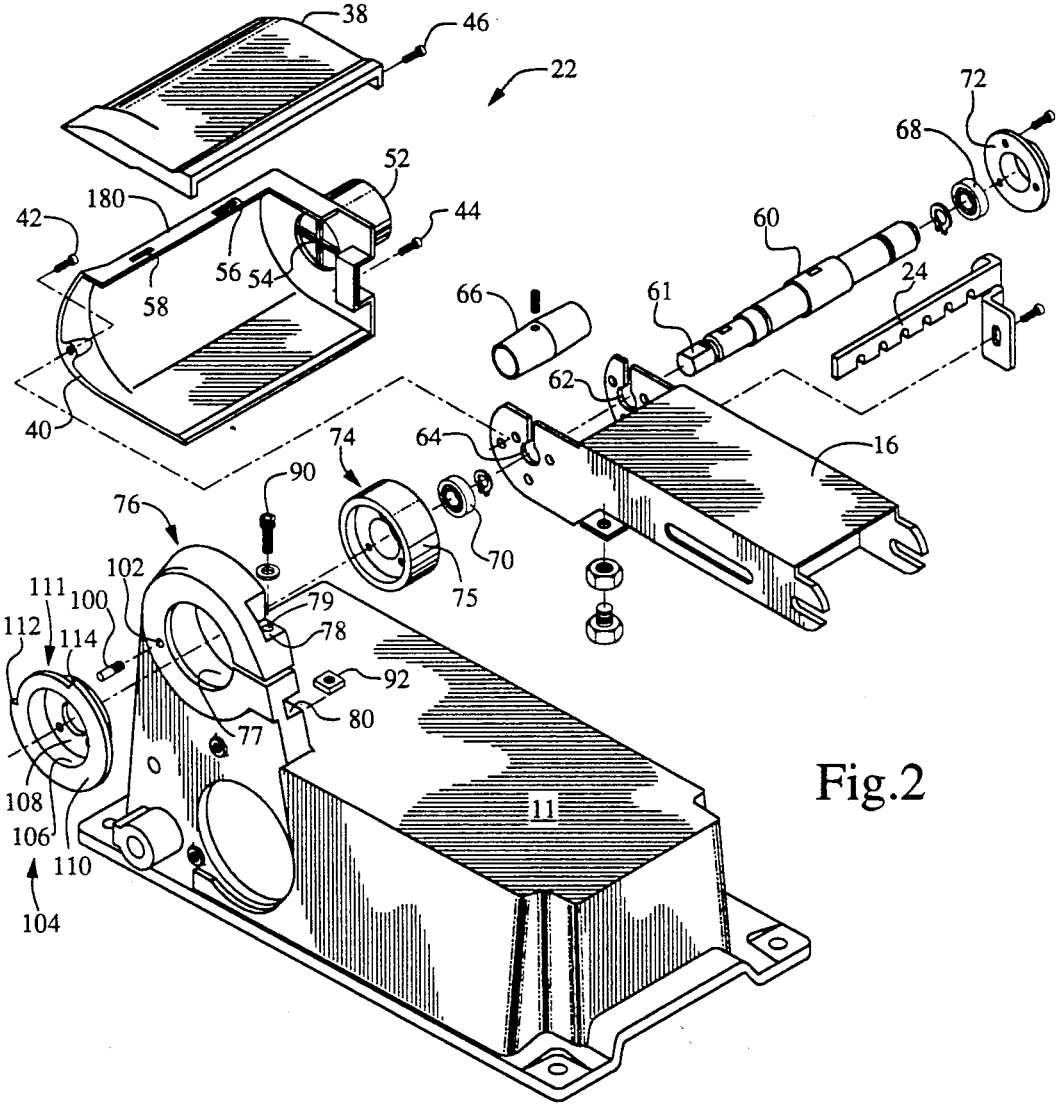
FIG. 2 is a partial exploded view of the belt disc sander illustrating the C-shaped collar and indexing pin which provides a quick release and enables the bed to be quickly moved from the horizontal to the vertical position in an accurate manner.

Referring now to FIG. 1, the novel belt/disc sander of the present invention is shown and designated generally by the numeral 10. It has a belt sander 12 and a disc sander 14. The belt sander 12 includes a belt bed 16 with an endless belt of sandpaper 18 placed thereon. An adjustment mechanism 20 allows a front idler pulley 21 to be moved inwardly sufficient to release pressure on the endless sand belt 18 to allow it to be removed and replaced as needed. A dust cover shown generally by the numeral 22 covers the drive shaft 60 as shown in FIG. 2 to collect the dust generated as the sandpaper belt 18 moves toward the dust collector 22 in FIG. 1. An end stop 24 is mounted directly in front of the dust collector 22 and is positioned slightly above the sandpaper belt 18 to allow the dust generated by the sanding operation to be carried under the stop 24 into the dust collector 22. The end stop 24 supports the items that are being sanded with the belt sander. It prevents the item being sanded from being moved along with belt 18.

In like manner, the disc sander 14 has an adjustable stop 26 which can be used to position the piece being sanded by the sandpaper disc 27. A dust cover housing 28 surrounds the sandpaper disc 27 and allows only the front portion thereof to be exposed for the purpose of the sanding operation. A vacuum attachment may be connected to orifice 30 coupled to the lower portion 154 of the dust cover 28. As will be seen later, the disc sander dust cover 28 is comprised of three portions. It has an upper back portion 184 (FIG. 13), a lower back portion 128 (FIG. 6) and a lower front portion 154 (FIG. 10) which has the orifice 30 for attachment to the vacuum system. Thus the disc 27 is surrounded on the lower half both front and back and the upper half on the back, thereby making a complete and effective dust collection system. Brackets 138–140 and 142–144 (FIG. 6) are formed on the lowest part of the lower back portion of the dust cover 28 for receiving an allen wrench 34 which will be used as described hereafter to operate a quick release to allow the belt sander bed to be moved from the horizontal position as shown to the vertical position. Switch 36 on the frame 11 turns the belt and disc sanders on and off. Both the belt sander 12 and the disc sander 14 are driven by the same drive shaft and therefore both rotate together when switch 36 is actuated.

A partially exploded schematic view of the belt sander 12 and its associated components is illustrated in FIG. 2. As can be seen in FIG. 2, belt bed 16 has orifices 62 and 64 at one end through which drive shaft 60 may be mounted. A cylindrical-type pulley 66 is mounted on shaft 60 to carry the sanding belt 18. End 61 of shaft 60 extends through bearing 70 and circular support wheel 74 which is rigidly attached to the belt bed 16 in any well-known manner such as by bolts or screws. The other end of shaft 60 is mounted in bearing 68 that fits in a recessed cup in mounting bracket 72 which is mounted to the other side of belt bed 16.

Circular support wheel 74 has a wide outer surface 75 which mates with the interior of a C-shaped clamp or collar 76 which also has a wide inner surface 77. The wide outer surface 75 of support structure 74 and the wide inner surface 77 of the C-shaped collar 76 are in mating contact. A recess 78 in the upper portion of C-shaped collar 76 has an orifice 79 therein. Recess 80 in the lower portion of C-shaped collar 76 has an orifice (not shown) that is in alignment with orifice 79. A hex bolt 90 inserted in the aligned orifices contacts nut 92 in recess 80 and can be used to compress or loosen the outer ends of C-shaped collar 76 to tighten the C-shaped collar 76 or loosen the C-shaped collar 76 about the circular support structure 74. When the belt bed 16 is in the horizontal position, the hex screw 90 can be tightened to lock the bed to the frame 11. If it is desired to raise the bed 16 to the vertical position, the hex wrench 34 on the lower front portion of the dust cover for the disc sander 14 can be used to loosen bolt 90 as a quick release and allow bed 16 to be moved to the vertical position. The bolt 90 can then be retightened and C-shaped collar 76 will engage circular support wheel 74 and lock the bed 16 in the vertical position.

An indexing pin 100 is rigidly fit in orifice 102 in C-shaped collar 76 to provide a positive stop for both the horizontal and vertical positions of the sander bed 16. An indexing plate 104 is associated with indexing pin 100 for enabling the belt sander bed 16 to be accurately positioned at the 0° and 90° positions. Plate 104 has an annular surface 106 that extends through the center of the C-shaped collar 76. A first inwardly extending flange 108 on a first end of the annular surface 106 on the inside of the C-shaped collar 76 attaches to the circular support wheel 74 which is of course attached to the belt bed 16. A second outwardly extending flange 110 on the other end of the annular surface 106 is on the outside of the C-shaped collar 76 such that when the belt bed 16 is rotated from 0° to 90°, the second flange 110 rotates with the belt bed. An arcuate recess 111 is formed in the second flange 110 for receiving the indexing pin 100. A first shoulder 112 in the recess 111 engages the indexing pin 100 at 0° horizontal belt bed 16 position and a second shoulder 114 engages the indexing pin 100 at a 90° vertical position of the belt bed 16 so as to provide automatic stops at the correct 0° and 90° belt bed positions.

Figure 4:
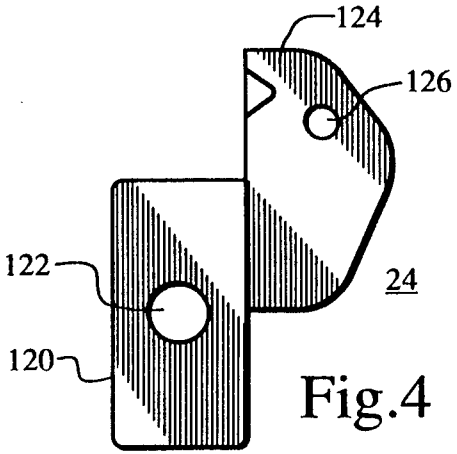
FIG. 4 is an end view of the end stop in FIG. 3.
Figure 5:
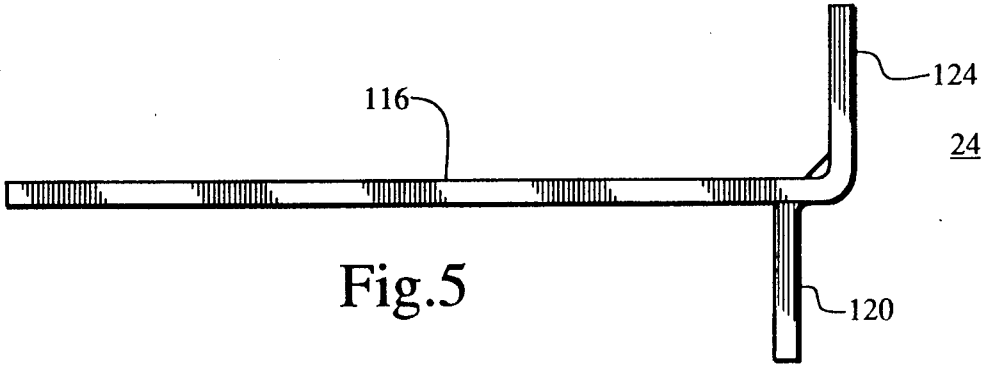
FIG. 5 is a top view of the end stop illustrated in FIG. 3.
Figure 3:
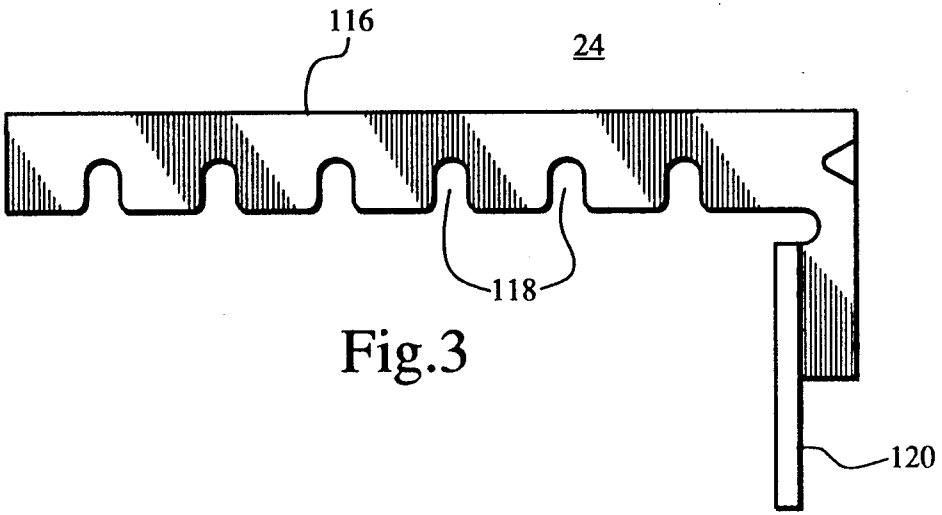
FIG. 3 is a front view of an end stop that is to be used with the belt bed.

The details of the end stop 24 are illustrated in FIGS. 3, 4 and 5. FIG. 3 is a front view of the end stop 24 which has an elongated rectangular plate 116 in which a plurality of U-shaped orifices 118 are formed. When the end stop 24 is mounted to the belt bed 16 by a bolt or screw through orifice 122 in side extension 120, the bottom surface of the rectangular plate 11 is just above the belt to allow dust generated by the moving belt to pass through the orifices 118 to the dust collector. The U-shaped orifices 118 have the open end of each U extending downwardly to the lower edge of the rectangular plate 116 thereby forming a comb-like structure. A transversely extending plate 124 extends to the rear of the rectangular plate 116 as shown in FIG. 5 and has an orifice 126 therein as shown in FIG. 4 for attaching the outer end of the upper dust collector section 38 to the end stop for support of both the upper dust collector section 38 and the rectangular plate 116.

Figure 7:
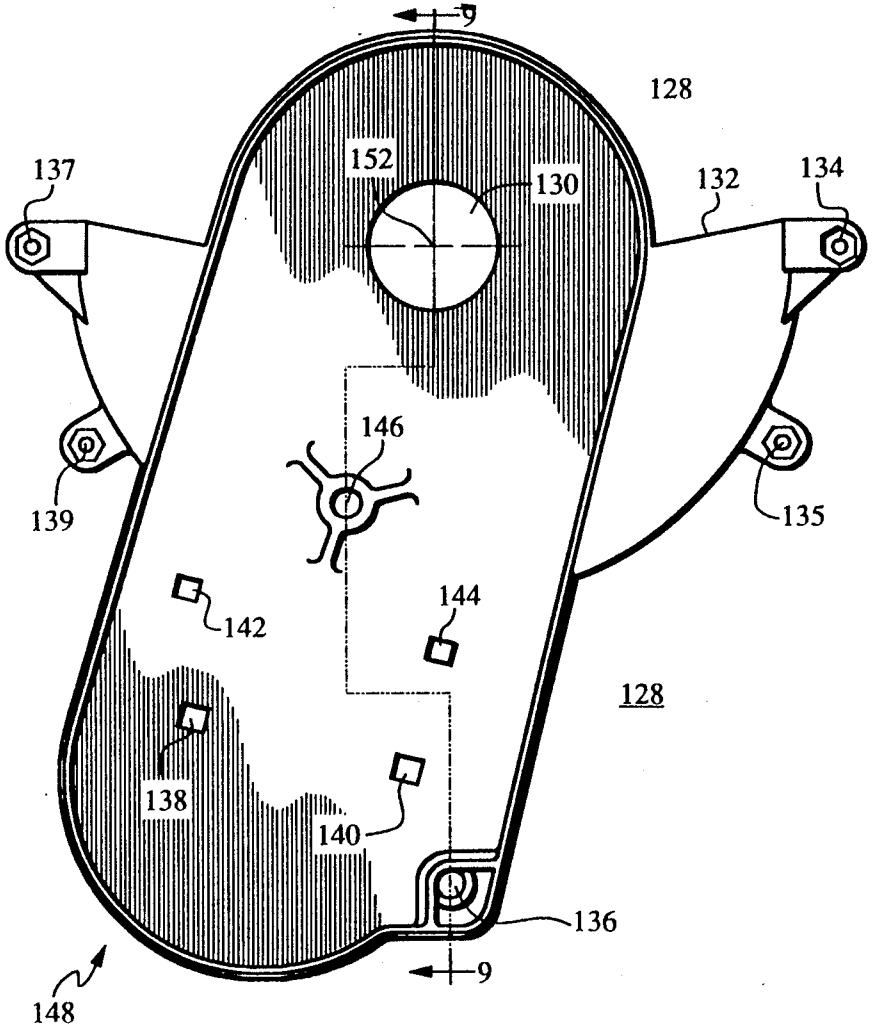
FIG. 7 is the back view of the lower rear portion of the dust collector illustrated in FIG. 6.
Figure 6:
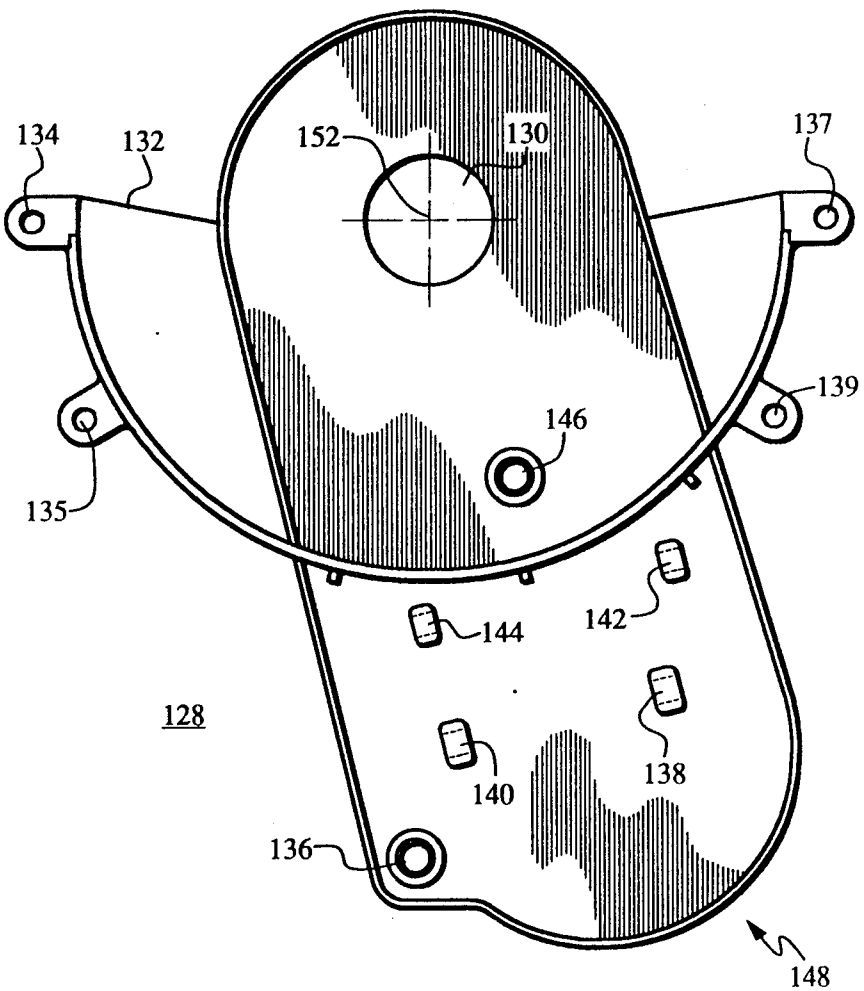
FIG. 6 is a front view of the lower rear portion of a dust collector for the disc sander on a belt/disc sander.

As stated earlier, shaft 60 that drives the sanding belt extends through C-shaped collar or clamp 76 where it is driven by a motor, not shown. The outer end of the shaft 60 also has attached thereto the disc sander 27. A dust collection system is provided for the sander 27 as illustrated in FIGS. 6–15. In FIG. 6, the lower back housing 128 is shown. It comprises a semicircular portion 132 having orifices 134, 135, 137 and 139 thereon for attachment to the top back portion and front lower portion of the dust collector. The dust is collected only in the semicircular portion 132 because the sanding disc rotates therein. The housing portion 148 below the semicircular portion 132 is on the outside of the sander and does not collect the dust. The housing 148 is integrally formed with semicircular housing portion 132 and extends downwardly therefrom. An orifice 130 is formed in the center portion of the semicircular housing portion 132 through which the end of shaft 60 protrudes with its centerline along point 152. Orifices 136 and 146 are used for bolts to attach the lower back housing 128 to the frame 11. Projections 138 and 140 are in alignment on the outside of the lower housing 148 as are projections 142 and 144. These projections have hexagonal orifices therein for receiving and retaining wrenches that can be used for the bed quick disconnect and bed adjustment bolts as partially shown in FIG. 1. FIG. 7 is a rear view of the lower rear portion 128 of the dust collector 14. All of the elements mentioned in relation to FIG. 6 can be seen from the back of unit 128 in FIG. 7.

Figure 8:
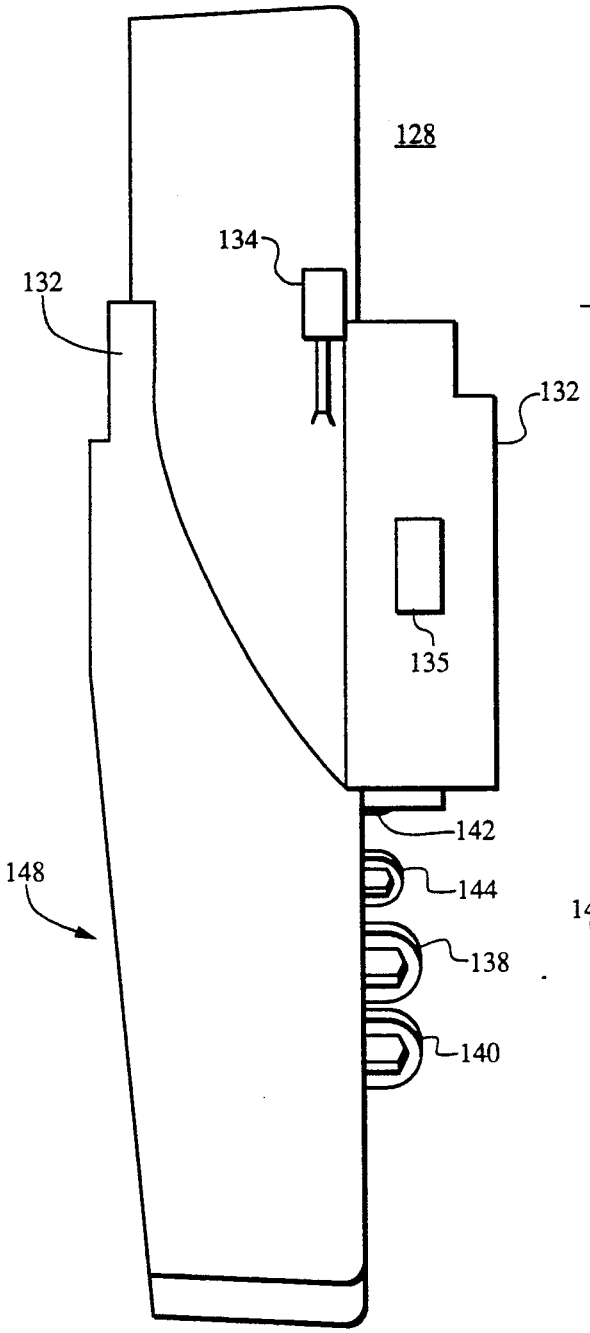
FIG. 8 is a side view of the lower rear portion of the dust collector shown in FIG. 6.
Figure 9:
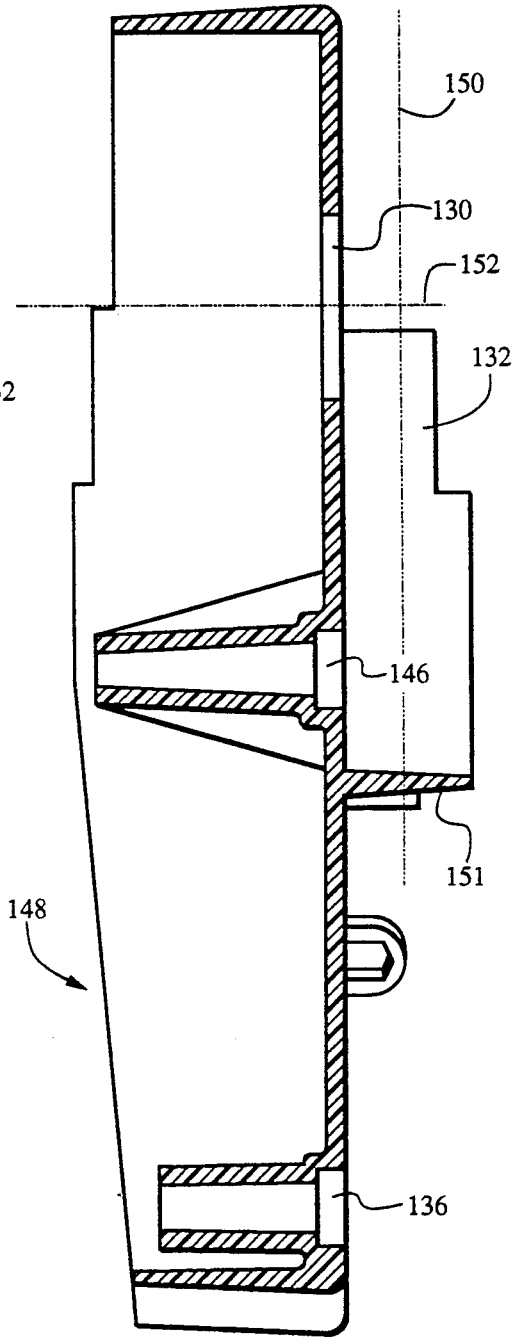
FIG. 9 is a cross-sectional view of the lower rear portion of the dust collector illustrated in FIG. 7 and taken along lines 9—9.

FIG. 8 is a side view of the lower rear portion 128 of the dust collector 14. It will be noted in the side view that the semicircular portion 132 extends in front of the extended housing 148. The sander disc 27 will rotate with the flat axis of the disc being encompassed by semicircular portion 132. FIG. 9 is a cross-sectional view of the portion 128 of the dust collector 14 taken along lines 9—9 of FIG. 7. In FIG. 9, the bolt attachment orifices 136 and 146 can be clearly seen. In addition, the semicircular portion 132 is shown clearly in front of the portion 148 where the shaft 60 would extend through orifice 130 along centerline 152. Note that the plane 150 of the rotating disc sander is encompassed within the semicircular portion 132.

Figure 10:
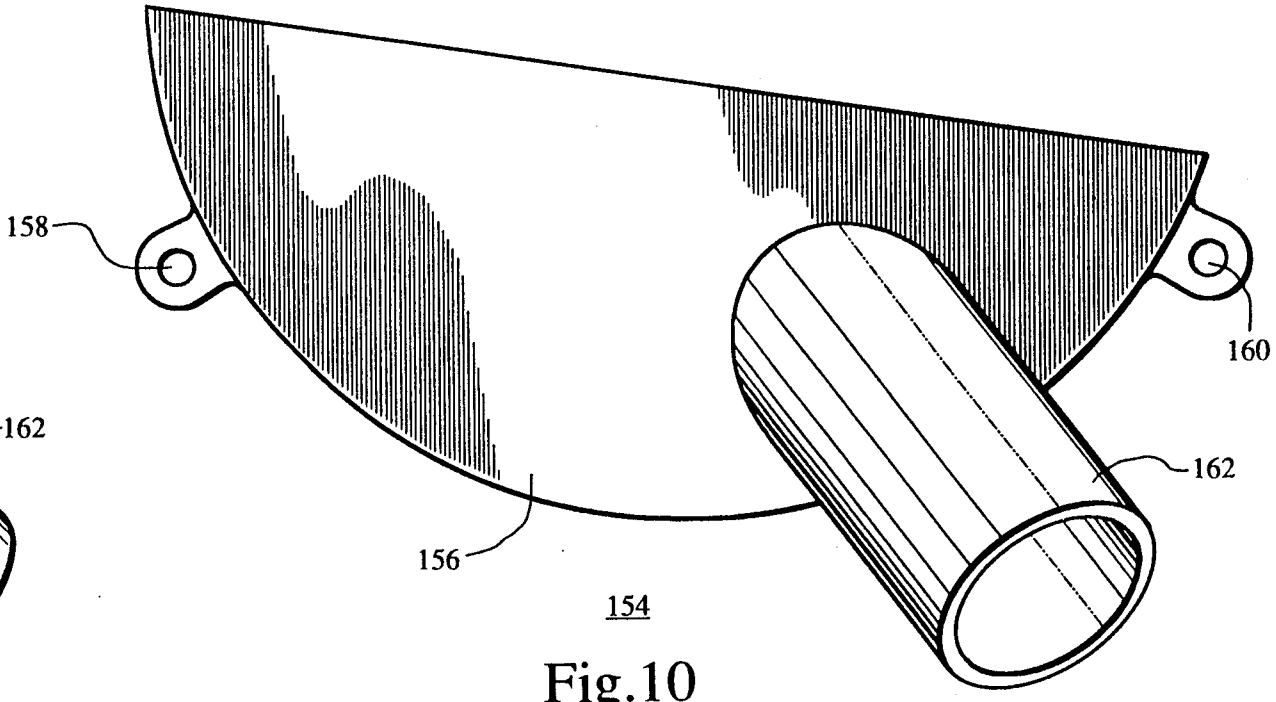
FIG. 10 is a front view of the lower front section of the dust collector for the disc sander.
Figure 11:
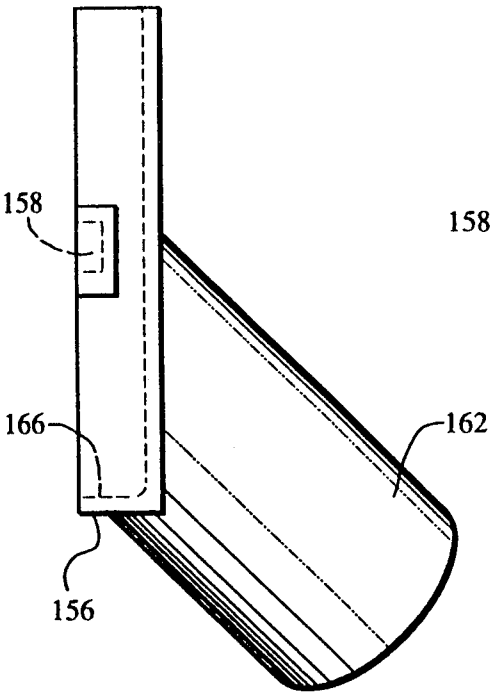
FIG. 11 is a side view of the lower front portion of the dust collector illustrated in FIG. 10.
Figure 12:
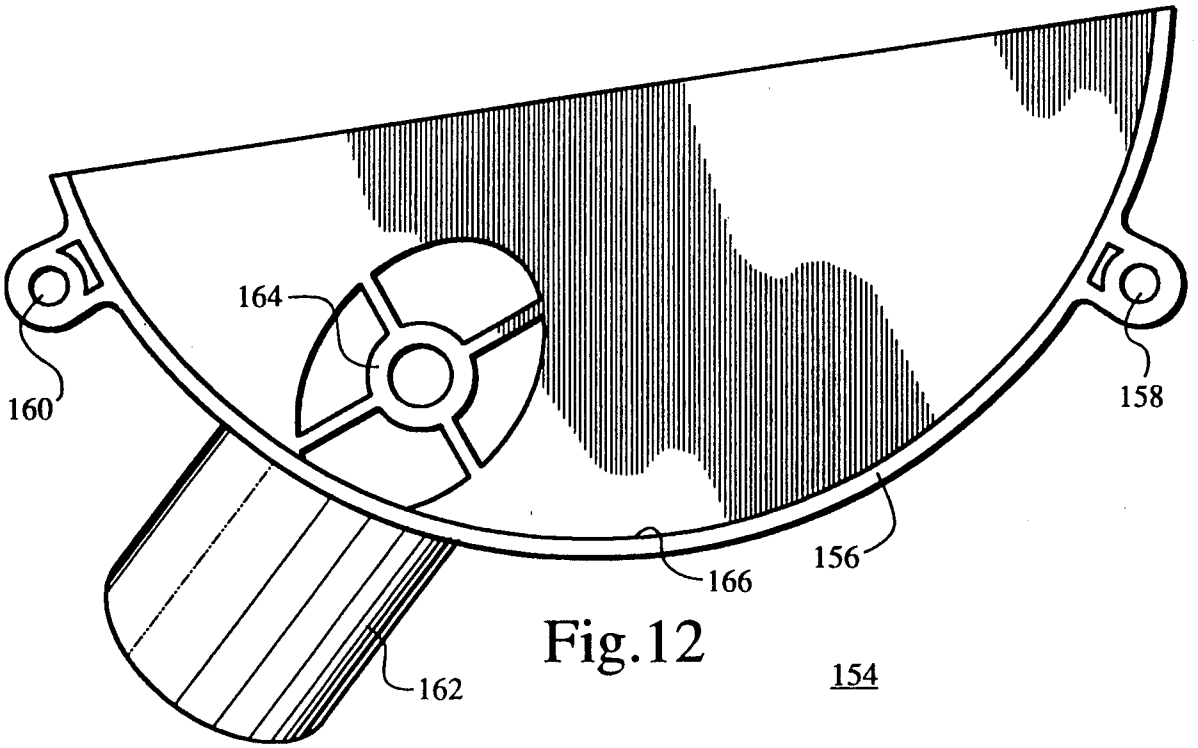
FIG. 12 is a rear view of the lower end portion of the lower front dust cover shown in FIG. 10.
Figure 17:
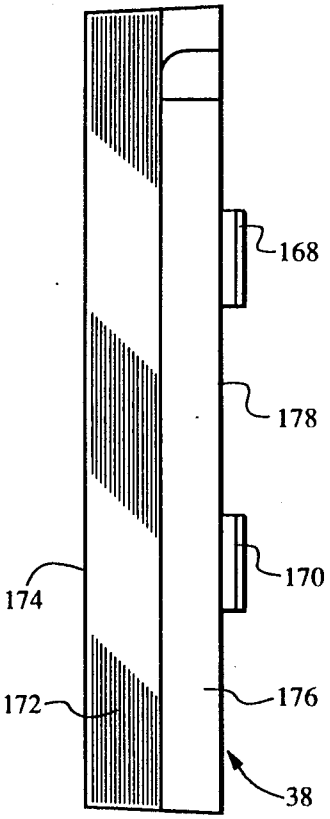
FIG. 17 is a right side view of the top portion of the sanding belt dust collector in FIG. 16.

The lower front portion of the dust collector 14 is shown in FIG. 10 and is indicated by the numeral 154. It can be removed, if necessary, to expose the entire disc for sanding purposes. In such case, there would be no dust collection. It has a substantially semicircular portion 156 from which a vacuum nozzle 162 extends and with which it is integrally formed. Orifices 158 and 160 allow attachment of the front lower portion 154 to the rear lower portion 128 by attachment to orifices 135 and 139 respectively as shown in FIG. 6. FIG. 11 is a side view of the lower front portion 154 of the dust collector 14. The inside shoulder 166 mates with and is under bottom surface 151 (FIG. 9) of the semicircular portion 132 of the lower rear section of the dust collector 128. FIG. 12 is a rear view of the lower front portion of the dust collector 154 illustrating the finger guard 164 that is placed in the orifice of the vacuum connection 162 to prevent one from inserting the fingers in the vacuum connection 162 and encountering the sander.

The upper rear portion of the dust collector is designated by the numeral 184 and is shown in FIG. 13. It also has strengthening ribs 192 and is formed with an arcuate section 186. Orifice 188 mates with orifice 134 in FIG. 6 and orifice 190 mates with orifice 137 in FIG. 6 to attach the upper rear portion to the lower rear portion of the dust collector 14. FIG. 14 is a rear view of the upper rear portion 184 of the dust collector 14. Again, the arcuate section 186 can be seen along with the orifices 188 and 190 and the centerline 152 for shaft 60. FIG. 15 is a side view of the upper rear portion 184 of the collector 14. It has a first flange section 192 which tapers downwardly at 194 to a rear section 196. The centerline 152 of the shaft 60 which drives the disc sander is illustrated.

Figure 16:
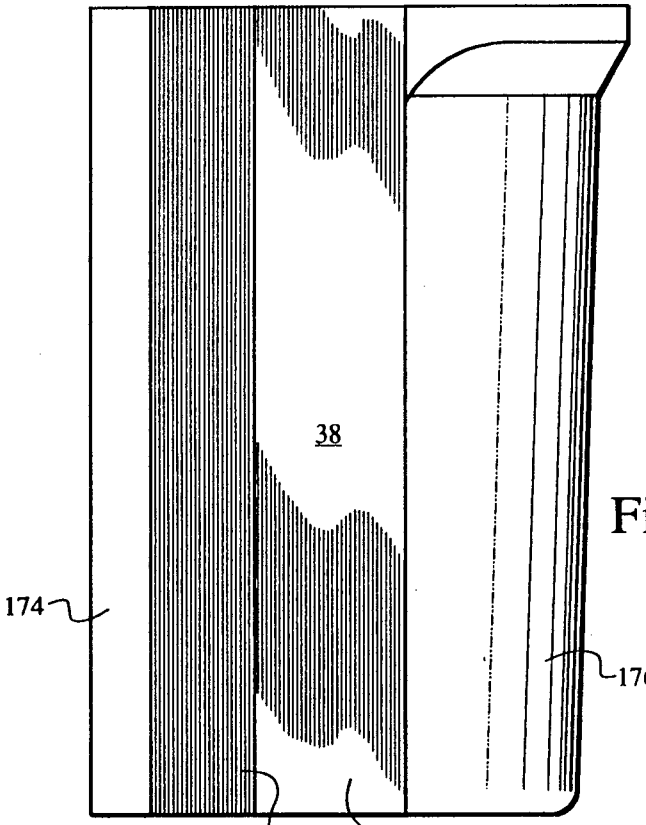
FIG. 16 is a top view of the dust cover for the belt sander dust collector.
Figure 19:
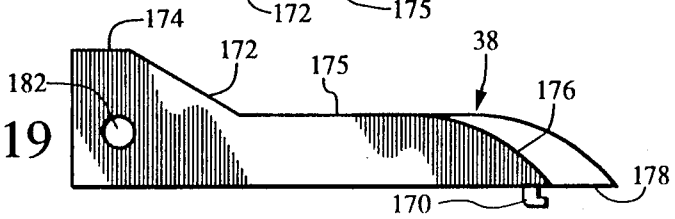
FIG. 19 is an end view of the upper section of the dust cover for the belt sander illustrated in FIG. 16.
Figure 18:
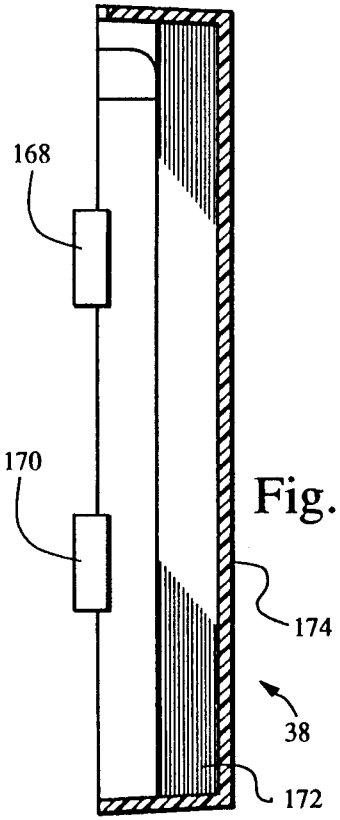
FIG. 18 is a left side view of the top section of the belt sander dust collector illustrated in FIG. 16.

FIGS. 16, 17, 18 and 19 all relate to the top section 38 of the belt sander dust collector 22. FIG. 16 is a top view of the upper section 38 which has a flat section 174 at the front thereof, a sloping surface 172 to a second flat surface 175 which tapers off in a curved surface 176 down to a flat undersurface 178 which mates with flat surface 180 on the lower portion 40 of the belt sander dust collector 22 as shown in FIG. 2. Note that the lower rear portion 176 has on the underside thereof L-shaped latching devices 168 and 170 which fit in corresponding orifices 56 and 58 of the lower section 40 as shown in FIG. 2. By removing the top section 38 of the belt dust collector 22 along with the end stop 24, an elongated workpiece that is longer than sanding belt bed 16 can be placed on the sanding belt. The user need only remove the bolt in orifice 122 (FIG. 4) that holds the top section 38 and end stop 24 to sanding belt bed 16. The end stop 24 and upper dust cover section 38 are removed by tipping them backwards until the L-shaped devices 168 and 170 are free from orifices 56 and 58. The upper surface 180 on the lower portion 40 is just below sanding belt 18 thus clearing a workpiece placed on belt 18.

Thus there has been disclosed a novel belt/disc sander device which has a quick release for enabling a belt bed to be selectively rotated 90° from the horizontal to the vertical. The C-shaped collar forming a portion of the frame engages a support means attached to the belt bed such that the C-shaped collar can be tightened about the support means in either the horizontal or vertical position of the bed to maintain the bed in the selected position. A bed position indexing pin is rigidly attached to the frame and engages a recess in a flange attached to the belt bed. The flange has first and second shoulders thereon spaced 90° apart which engage the indexing pin at both the 0° and 90° positions to allow quick and accurate positioning of the bed at those positions.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

We claim:

1. In a belt/disc sander having both a disc sander and a belt sander, a quick release for enabling a belt bed for the belt sander to be selectively rotated 90° from the horizontal to the vertical comprising:

a frame;

a C-shaped collar with a smooth inner surface forming a portion of the frame;

a circular support structure attached to the belt bed and having a smooth outer surface positioned within and in mating contact with the smooth inner surface of the C-shaped collar for enabling the belt bed to be selectively rotated 90° from a horizontal position to the vertical position;

means for tightening the C-shaped collar about the support means in either the horizontal or vertical position of the belt bed to maintain the bed in the selected position;

a bed position indexing pin extending outwardly from the C-shaped collar; and a pin engaging means associated with the circular support structure for engaging the bed position indexing pin at 0° and 90° positions of the belt bed to provide a positive stop for positioning the belt bed accurately in the 0° and 90° positions.

2. A belt sander as in claim 1 wherein said means for tightening said C-shaped collar comprises:

a recess in each outer end of the C-shaped collar;

an orifice extending from one recess through the other recess in alignment with each other; and a bolt inserted in said orifice which, when tightened, locks said C-shaped collar to said circular support structure so as to lock said bed in the selected position.

3. A belt sander as in claim 1 wherein said pin engaging means comprises:

an annular fixture extending through said C-shaped collar;

a first inwardly extending flange on a first end of said annular fixture on the inside of said C-shaped collar for attachment to said circular support structure;

a second outwardly extending flange on the other end of said annular fixture on the outside of said C-shaped collar such that when said belt bed is rotated from 0° to 90°, said second flange rotates with said belt bed;

an arcuate recess in said second flange for receiving said indexing pin; and a first shoulder in said recess for engaging said indexing pin at a 0° horizontal bed position and a second shoulder for engaging said indexing pin at a 90° vertical belt bed position so as to provide automatic stops at the correct 0° and 90° belt bed positions.

* * * * *